United States Patent [19]

Lindner et al.

[11] Patent Number: 4,592,854

[45] Date of Patent: Jun. 3, 1986

[54] STEEL ETCHANT

[75] Inventors: Walter E. Lindner; Dolphus L. Coggins, both of St. Louis, Mo.

[73] Assignee: McDonnell Douglas Corporation, St. Louis, Mo.

[21] Appl. No.: 690,095

[22] Filed: Jan. 9, 1985

[51] Int. Cl.[4] ..... C09K 13/08; C23F 1/00

[52] U.S. Cl. ..... 252/79.3; 156/656; 156/664; 252/79.4

[58] Field of Search ..... 252/79.3, 79.4; 156/656, 659.1, 664, 642; 134/3, 41

[56] References Cited

U.S. PATENT DOCUMENTS

| | | | |
|---|---|---|---|
| 2,177,751 | 10/1939 | Sikorski | 41/42 |
| 2,434,021 | 1/1948 | Thompson et al. | 41/42 |
| 2,647,864 | 8/1953 | Goffredo | 204/17 |
| 2,650,157 | 8/1953 | Cochran | 41/42 |
| 2,890,944 | 6/1959 | Hays | 156/664 X |
| 2,940,838 | 6/1960 | Snyder et al. | 156/664 X |
| 3,033,795 | 5/1962 | Brevik | 252/142 |
| 3,052,582 | 9/1962 | Snyder | 252/79.4 X |
| 3,171,767 | 3/1965 | Bellinger | 156/20 |
| 3,230,172 | 1/1966 | Casperini | 252/101 |
| 3,253,968 | 5/1966 | Shepherd et al. | 156/664 X |
| 3,301,719 | 1/1967 | Groshart | 148/6.21 |
| 3,367,874 | 2/1968 | Haviland | 252/79.2 |
| 3,479,293 | 9/1969 | Bellinger | 252/79.4 |
| 4,264,377 | 4/1981 | Schafer | 148/6.14 |
| 4,284,468 | 8/1981 | Stearns | 156/661.1 |

*Primary Examiner*—William A. Powell

*Attorney, Agent, or Firm*—Cohn, Powell & Hind

[57] ABSTRACT

An etchant composition suitable for use with a wide variety of steel compositions contains between about:

| | |
|---|---|
| 10–300 ml | 75% $H_3PO_4$ |
| 100–700 ml | $HNO_3$ (42° Baume) |
| 80–100 ml | HF (70%) |
| 1–50 gm | $NaNO_3$ |
| 10–100 gm | Urea |
| 1–30 gm | Sodium Benzoate |
| 5–200 gm | Dissolved Iron or Steel |
| Balance | Water |

The composition is very fast acting etchant compared to prior etchants. The etchant has a very uniform etch rate leaving smooth etched surfaces, including over fillets and similar structures. The etchant is thus particularly suitable for chemical milling of steels and parts fabricated of steels.

21 Claims, No Drawings

STEEL ETCHANT

BACKGROUND AND SUMMARY OF THE INVENTION

This invention relates to chemically etching steel and in particular to a method and composition for chemical etching and milling effective on a wide variety of steel alloys.

Applicants are aware of the following U.S. Pat. Nos. 2,177,751, 2,434,021, 2,647,864, 2,650,157, 3,033,795, 3,171,767, 3,230,172, 3,301,719, 3,367,874, 3,479,293, 4,264,377, 4,284,468.

The disclosures of the above patents are incorporated by reference herein.

There are numerous methods and compositions known for etching steels. These prior methods and compositions generally are limited in effectiveness to a particular steel or type of steel and are ineffective on a variety of steels. Thus it has been necessary to select an etchant for the particular steel to be etched. This often requires the shipping, storing, and handling of a large number of dangerous etchants.

Even where the proper prior etchant was selected, etching was slow and difficult to control. It has been particularly difficult to achieve a uniform etch with the prior etchants, especially with the faster acting etchants. Thus, it has been difficult to chemically mill steel parts, especially for high precision and high volume applications.

Generally, the prior etchants have been based upon nitric acid, and their use has resulted in the liberation of large volumes of oxides of nitrogen. The prior etchants have also typically contained chromates or other potential pollution sources that have made their use dangerous and their disposal difficult.

The present invention is a method and composition for etching steel. Applicants' etchant has been found effective on a wide range of steels, including all but the high alloy nickel-chromium stainless steels. The composition has been found effective for chemically etching and milling a wide variety of steels, including 4130, 4140, 4340, 4330, 300M, H-HP9-4-30, D6AC, 1018, and other low and intermediate steel alloys. Thus the composition eliminates the problems of shipping, storing, and handling a wide variety of etchants to work with multiple types of steels. The composition is very fast compared to prior etchants. The etching is very uniform and leaves a very smooth etched surface, including at fillets and similar structures. Thus the etchant is particularly suited for chemical milling of steels and parts fabricated of steel.

The composition includes nitric acid and hydrofluoric acid. The new etchant incorporates a variety of etch control additives, such as urea, to keep metal surfaces and fillets smooth by buffering the acidic reaction. Urea also inhibits the formation of nitrogen oxides usually generated in the chemical milling of steel with nitric acid. Sodium benzoate, in particular, is added to achieve a more uniform etch rate. Phosphoric acid may also be added to achieve a smooth surface finish. Sodium nitrate can be added to supply additional sodium ions to retard the formation of scale on the steel part being treated and on the treatment tank. Iron can be added to the composition to help achieve a uniform etch rate, so either a small amount of iron or steel can be dissolved in the composition. Thus the composition can be used in precision chemical etching and milling. The more uniform etch permits stronger, faster etching compositions to be used, reducing treatment times.

The method of chemical etching or milling of this invention includes the preparation of a sufficient quantity of the composition in a suitable container or tank. The steel parts to be etched or milled are immersed in the tank for the appropriate period of time to remove the desired amount of material. The components of the etchant, such as nitric acid and hydrofluoric acid, can be replenished as they are consumed during etching or milling of the steel. In a preferred composition, and method of using the composition, a liter of the etchant contains between about:

| | |
|---|---|
| 10–300 ml | 75% $H_3PO_4$ |
| 100–700 ml | $HNO_3$ (42°/Be) |
| 80–100 ml | HF (70%), |
| 1–50 g | $NaNO_3$, |
| 10–100 g | Urea, |
| 1–30 g | Na Benzoate |
| 5–200 g | iron or steel |
| balance | water |

A preferred composition, which has been found to be particularly effective, contains on a per liter basis:

| | |
|---|---|
| 100 ml | 75% $H_3PO_4$ |
| 500 ml | $HNO_3$ (42°/Be) |
| 100 ml | HF (70%) |
| 40 g | Urea |
| 10 g | $NaNO_3$ |
| 4 g | Na Benzoate |
| 40 g | dissolved steel |
| Balance | water |

DETAILED DESCRIPTION OF THE PREFERRED EMBODIMENTS

The invention is a chemical etchant and milling composition containing nitric, phosphoric and hydrofluoric acids, and the method of its use. The composition can further contain urea and sodium benzoate. Sodium nitrate can also be included to retard scale formation. Small amounts of steel or iron can be dissolved in the composition, as well, to provide a more uniform etch.

The invention is shown in the following Examples:

EXAMPLE 1

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured 4340 steel coupon for 600 seconds. After treatment the steel was examined. The surface appeared smooth, clean and uniform. The part was remeasured and 0.025 inch of material had been removed from the surface of the coupon.

EXAMPLE 2

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured 4140 steel coupon for 600 seconds. After treatment the steel was examined. The surface appeared smooth, clean and uniform. The part was remeasured and 0.031 inch of material had been removed from the surface of the coupon.

EXAMPLE 3

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured 4130 steel coupon for 600 seconds. After treatment the steel was examined. The surface appeared smooth, clean and uniform. The part was remeasured and 0.030 inch of material had been removed from the surface of the coupon.

EXAMPLE 4

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured 4330 steel coupon for 600 seconds. After treatment the steel was examined. The surface appeared smooth, clean and uniform. The part was remeasured and 0.027 inch of material had been removed from the surface of the coupon.

EXAMPLE 5

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |

-continued

| | |
|---|---|
| balance | water |

This solution was used on a measured 300M steel coupon for 600 seconds. After treatment the steel was examined. The surface appeared smooth, clean and uniform. The part was remeasured and 0.022 inch of material had been removed from the surface of the coupon.

EXAMPLE 6

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured D6AC steel coupon for 600 seconds. After treatment the steel was examined. The surface appeared smooth, clean and uniform. The part was remeasured and 0.025 inch of material had been removed from the surface of the coupon.

EXAMPLE 7

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured H-HP9-4-30 steel coupon for 600 seconds. After treatment the steel was examined. The surface appeared smooth, clean and uniform. The part was remeasured and 0.027 inch of material had been removed from the surface of the coupon.

EXAMPLE 8

A liter of etchant was made by mixing the following ingredients:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| balance | water |

This solution was used on a measured 1018 steel coupon for 600 seconds. After treatment the steel was examined. The surface appeared smooth, clean and uniform. The part was remeasured and 0.068 inch of material had been removed from the surface of the coupon.

EXAMPLE 9

A liter of etchant was made by mixing the following ingredients:

| | |
|---|---|
| 50 ml | 75% Phosphoric Acid |
| 300 ml | 42° Baume Nitric Acid |
| 50 ml | 70% Hydroflouric Acid |
| 40 g | Urea |
| 10 g | Sodium Nitrate |
| 5 g | Sodium Benzoate |
| balance | water |

This solution was used on a measured 1018 steel coupon for 600 seconds. After treatment the steel was examined. The surface appeared smooth, clean and uniform. The part was remeasured and 0.010 inches of material had been removed from the surface of the coupon.

EXAMPLE 10

A liter of etchant was made by mixing the following ingredients:

| | |
|---|---|
| 50 ml | 75% Phosphoric Acid |
| 300 ml | 42° Baume Nitric Acid |
| 50 ml | 70% Hydroflouric Acid |
| 40 g | Urea |
| 10 g | Sodium Nitrate |
| 5 g | Sodium Benzoate |
| 2 g | Dissolved Steel |
| balance | water |

This solution was used on a measured 4130 steel coupon for 600 seconds. After treatment the steel was examined. The surface appeared smooth, clean and uniform. The part was remeasured and 0.011 inches of material had been removed from the surface of the coupon.

EXAMPLE 11

A liter of etchant was made by mixing the following ingredients:

| | |
|---|---|
| 50 ml | 75% Phosphoric Acid |
| 300 ml | 42° Baume Nitric Acid |
| 50 ml | 70% Hydroflouric Acid |
| 40 g | Urea |
| 10 g | Sodium Nitrate |
| 5 g | Sodium Benzoate |
| 2 g | Dissolved Steel |
| balance | water |

This solution was used on a measured 300M steel coupon for 600 seconds. After treatment the steel was examined. The surface appeared smooth, clean and uniform. The part was remeasured and 0.010 inches of material had been removed from the surface of the coupon.

It will be appreciated by one skilled in the art that various modifications may be made in the specific embodiments disclosed herein without departing from the invention. The examples are included herein for illustrative purposes. The scope of the invention is limited only by the following claims and their equivalents.

We claim:

1. A steel etchant composition effective on a wide variety of steel alloys, the composition comprising nitric acid and hydrofluoric acid in amounts effective to etch a wide variety of steel alloys and an etch rate control agent, the etch control agent being effective in the amount present to achieve a uniform etch rate in a wide variety of steel compositions under rapid etch conditions.

2. The etchant composition of claim 1 comprising between about 100–700 ml/l of 42° Baume nitric acid.

3. The etchant composition of claim 2 comprising between about eight percent and about 800–100 ml/l of 70% hydrofluoric acid.

4. A steel etchant composition effective on a wide variety of steel alloys, the composition comprising nitric acid and hydrofluoric acid in amounts effective to etch a wide variety of steel alloys and an etch control agent, the etch control agent being effective in the amount present to achieve a uniform etch rate in a wide variety of steel compositions under rapid etch conditions, the etchant composition further comprising sufficient sodium ions to retard the formation of scale.

5. The etchant composition of claim 4 comprising sodium nitrate in an amount effective to provide sufficient sodium ions to the composition to retard the formation of scale.

6. The etchant composition of claim 5 comprising between about 1 and about 50 grams per liter of sodium nitrate.

7. A steel etchant composition effective on a wide variety of steel alloys, the composition comprising nitric acid and hydrofluoric acid in amounts effective to etch a wide variety of steel alloys and an etch control agent, the etch control agent being effective in the amount present to achieve a uniform etch rate in a wide variety of steel compositions under rapid etch conditions, the etchant composition further comprising sodium benzoate in an amount effective to achieve a uniform etch rate.

8. The etchant composition of claim 7 comprising between about 1 and about 30 grams per liter sodium benzoate.

9. A steel etchant composition effective on a wide variety of steel alloys, the composition comprising nitric acid and hydrofluoric acid in amounts effective to etch a wide variety of steel alloys and an etch control agent, the etch control agent being effective in the amount present to achieve a uniform etch rate in a wide variety of steel compositions under rapid etch conditions, the etchant composition further comprising urea in an amount effective to buffer the composition and keep the surfaces and fillets of the steel being etched smooth.

10. The etchant composition of claim 9 comprising between about 10 and about 100 grams per liter urea.

11. The etchant composition of claim 9 further comprising sodium benzoate in an amount effective to achieve a uniform etch rate.

12. The etchant composition of claim 11 further comprising sodium nitrate in an amount effective to provide sufficient sodium ions to the composition to retard the formation of scale on the steel being etched.

13. The etchant composition of claim 12 further comprising iron dissolved in the composition.

14. A steel etchant composition effective on a wide variety of steel alloys, the composition comprising between 100–700 ml/l of 42° Baume nitric acid and between about 8 percent and 800–100 ml/l of 70% hydrofluoric acid, the nitric acid and hydrofluoric acid being in amounts effective to etch a wide variety of steel alloys, the etchant composition further comprising between about 10 and about 100 grams per liter urea and an etch control agent, the etch control agent being effective in the amount present to achieve a uniform etch rate in a wide variety of steel compositions under rapid etch conditions.

15. The etchant composition of claim 14 further comprising between about 1 and about 30 grams per liter sodium benzoate.

16. The etchant composition of claim 15 further comprising between about 1 and about 50 grams per liter sodium nitrate.

17. The etchant composition of claim 16 further comprising between about 5 and about 200 grams per liter of dissolved iron.

18. A steel etchant composition effective on a wide variety of steel alloys, a liter of the composition containing between about 100–700 ml/l of 42° Be nitric acid, between about 80–100 ml/l of 70% hydrofluoric acid, between about 10–300 ml/l of 75% phosphoric acid, between about 10–100 gm/l urea, between about 1–50 g/l sodium nitrate, between about 1–30 g/l sodium benzoate, and up to about 200 g/l of dissolved iron.

19. The steel etchant of claim 18 wherein a liter of the composition contains about:

| | |
|---|---|
| 100 ml | 75% Phosphoric Acid |
| 500 ml | 42° Baume Nitric Acid |
| 100 ml | 70% Hydroflouric Acid |
| 40 g | Urea |
| 10 g | Sodium Nitrate |
| 4 g | Sodium Benzoate |
| 40 g | Dissolved Steel |
| Balance | Water. |

20. A method of etching steel effective to rapidly and uniformly etch a wide variety of steel alloys comprising providing an etchant bath containing nitric acid and hydrofluoric acid in amounts effective to etch steel alloys of a variety of compositions, providing between about 1 to 30 grams per liter of sodium benzoate in the etchant bath, the sodium benzoate being effective to achieve a uniform etch rate in the process during rapid etching and etching steel components therein.

21. The etchant composition of claim 3 further comprising between about 10–30 ml/l of 75% phosphoric acid.

* * * * *